United States Patent [19]

Shizu

[11] 4,117,432

[45] Sep. 26, 1978

[54] DEFLECTION YOKE WITH UNITARY COIL FRAME

[75] Inventor: Kazunori Shizu, Yokohama, Japan

[73] Assignee: Denki Onkyo Co., Ltd., Tokyo, Japan

[21] Appl. No.: 650,130

[22] Filed: Jan. 19, 1976

[30] Foreign Application Priority Data

Jan. 17, 1975 [JP] Japan ..... 50-8150

[51] Int. Cl.[2] ..... H01F 7/00

[52] U.S. Cl. ..... 335/210; 335/213

[58] Field of Search ..... 335/210, 212, 213, 299

[56] References Cited

U.S. PATENT DOCUMENTS

| | | | |
|---|---|---|---|
| 3,430,169 | 2/1969 | Gabor | 335/213 |
| 3,601,731 | 8/1971 | Christana et al. | 335/213 X |
| 3,652,966 | 3/1972 | Meier | 335/213 X |
| 3,835,426 | 9/1974 | Torsch | 335/210 |
| 3,875,543 | 4/1975 | Gostyn et al. | 335/213 X |
| 3,895,329 | 7/1975 | Logan et al. | 335/213 X |
| 4,023,129 | 5/1977 | Krate et al. | 335/213 X |

*Primary Examiner*—George Harris

*Attorney, Agent, or Firm*—Armstrong, Nikaido, Marmelstein & Kubovcik

[57] ABSTRACT

A deflection yoke includes a coil frame comprising a flared body and a pair of end formations at the front and rear ends of the body. Around each end formation, the frame is formed with a plurality of grooves, and a deflection coil is directly wound on the inner surface of the frame in a saddle configuration, utilizing the grooves.

11 Claims, 14 Drawing Figures

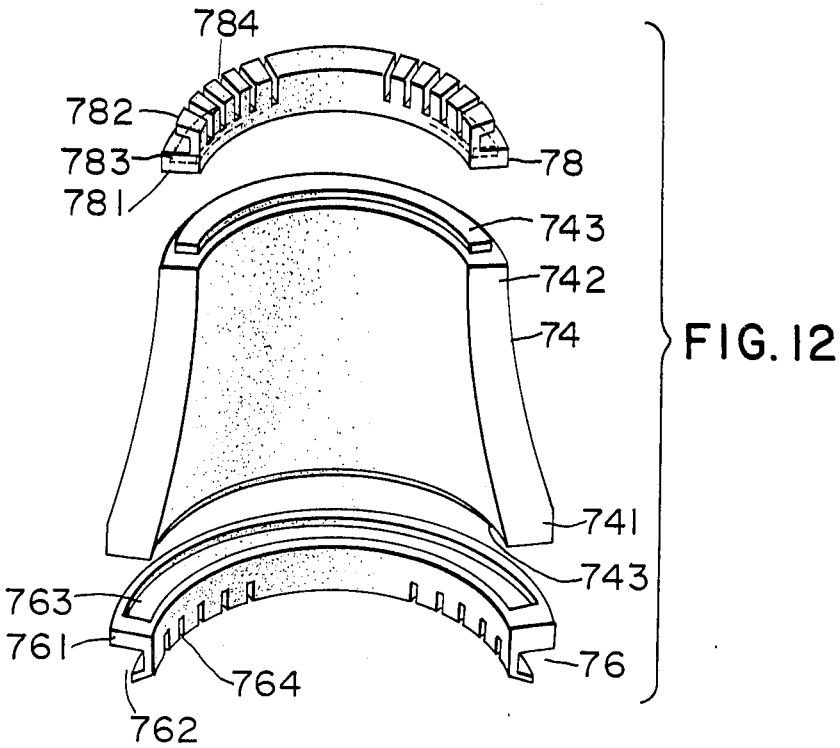
FIG. 12
FIG. 13
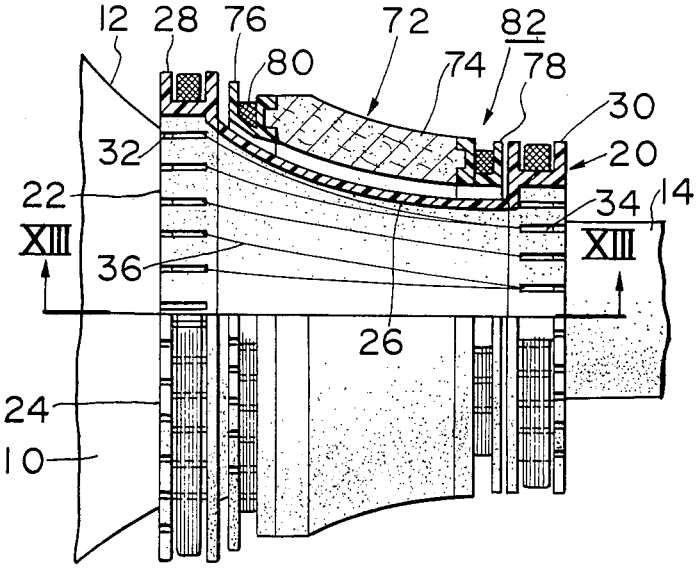

DEFLECTION YOKE WITH UNITARY COIL FRAME

BACKGROUND OF THE INVENTION

The invention relates to a deflection yoke for a cathode ray tube, and more particularly to a deflection yoke having a deflection coil which is directly wound on the inner surface of a coil frame in a saddle configuration.

A deflection yoke which is mounted on the cathode ray tube is manufactured in a number of arrangements. In one arrangement, both horizontal and vertical deflection coils are wound in toroidal form directly on the core of the deflection yoke. In another arrangement, the both coils are wound in a saddle configuration along the core. In a still further arrangement, the horizontal deflection coil is wound in a saddle configuration while the vertical deflection coil is wound in toroidal form. These deflection yokes are adopted depending on the intended use.

In a conventional deflection yoke in which at least one of the horizontal and vertical deflection coils is wound in a saddle configuration, the saddle-shaped coil is formed by winding a conductor on a metallic winding form and applying heat and pressure thereto. However, such manufacturing imposes a limitation on the saddle shape of the coil formed as well as the distribution of turns of the conductor, making it difficult to achieve a particular distribution of turns of the conductor so that a required deflection field may be obtained. In addition, during manufacture, the conductor may move by slippage to change the position of turns, which causes another difficulty in maintaining a desired distribution of turns, thereby degrading the deflection characteristic. Adhesive wires, for example, which lend themselves to adhesion, must be used to maintain the saddle configuration. Additionally, where the number of turns is reduced, a saddle configuration cannot be effectively achieved, with a result that an excess amount of wire had to be used though unnecessary.

The invention provides a deflection yoke which eliminates the above mentioned disadvantages.

SUMMARY OF THE INVENTION

A deflection yoke according to the invention comprises a coil frame including a flare-shaped body having a pair of end formations at its front and rear ends, and a pair of horizontal and vertical deflection coils. Around each end formation, a plurality of grooves are formed in the coil frame, and a conductor is passed across the grooves in the respective end formations of the coil frame to wind the deflection coils directly on the inner surface of the frame in a saddle configuration.

Preferably, means are provided for constraining the position of turns of the conductor which forms the deflection yoke on the inner surface of the coil frame.

BRIEF DESCRIPTION OF THE DRAWINGS

FIG. 12 is an exploded perspective view of the coil frame shown in FIG. 10; and FIG. 13 is a side elevation of the deflection yoke constructed according to a further embodiment of the invention, with the upper half above the centerline XIII—XIII being shown in section.

DETAILED DESCRIPTION OF INVENTION

Figure 1:
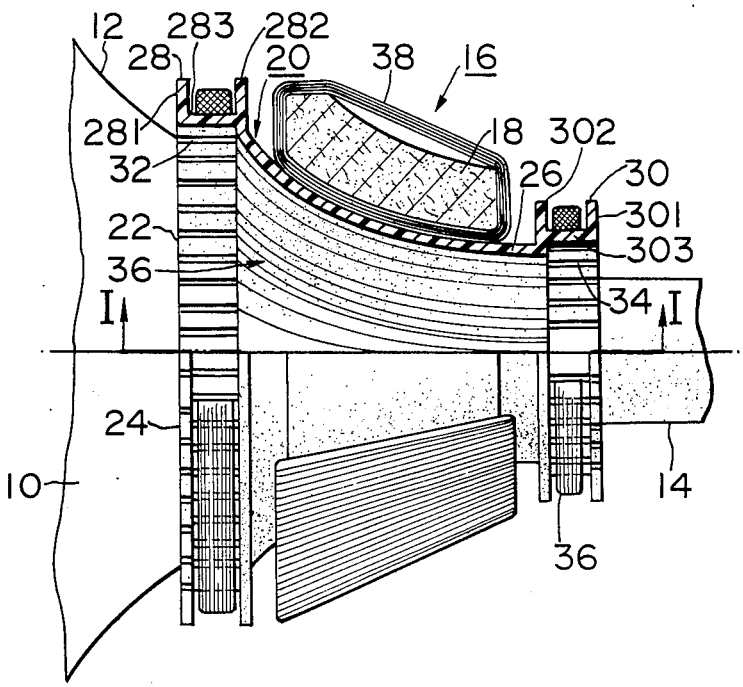
FIG. 1 is a side elevation of the deflection yoke according to one embodiment of the invention, with the upper half above the centerline I—I being shown in section.
Figure 2:
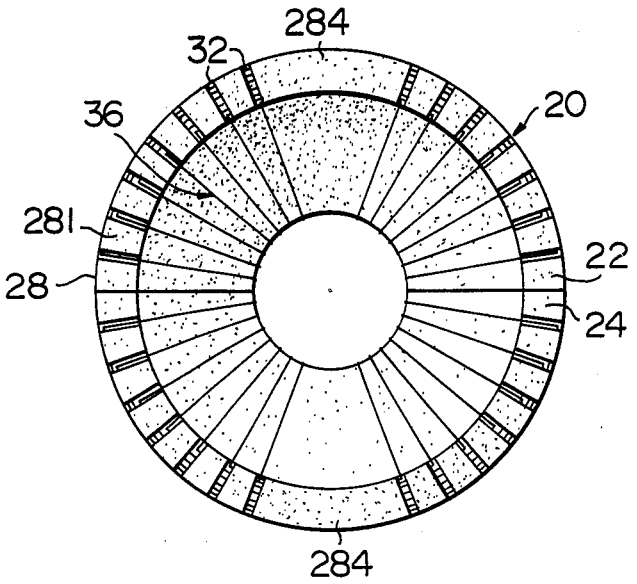
FIG. 2 is a front view of the deflection yoke shown in FIG. 1.
Figure 14:
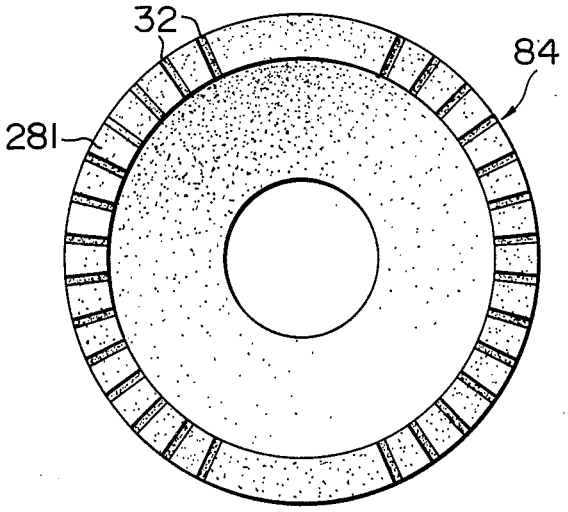
FIG. 14 is a front view of a unitary deflection yoke of the present invention.
Figure 3:
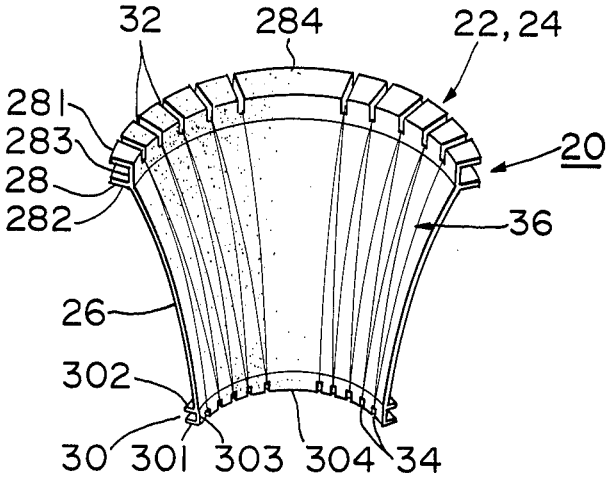
FIG. 3 is a perspective view of one frame half used in the deflection yoke of FIG. 1.

Referring to FIG. 1, there is shown a cathode ray tube 10 having a flared portion 12 which is contiguous with a neck 14 on which a deflection yoke 16 is mounted. The yoke 16 comprises a core 18 formed of a magnetic material such as ferrite, and a sleeve-shaped coil frame 20 which comprises an insulating material, for example, polypropylene, and which is secured to the inside of the annulus formed by the core 18. The coil frame 20 is formed in a pair of frame halves 22, 24, each of which includes a flare-shaped body 26 extending along the inside of the core 18. At its front end (toward the flared portion 12 of the tube 10) and rear end (toward the neck 14 of the tube 10), the body 26 is integrally formed with a pair of end formations 28, 30, each of which comprises a pair of flanges 281, 282; 301, 302, and an annular portion 283, 303 which extends between the pair of flanges. As shown in FIGS. 2 and 3, each of the end formations 28, 30 is provided with a plurality of grooves 32, 34 in succession which extend radially through the flange 281, 301 and axially into the annular portion 283, 303. As will be noted from FIG. 2, these grooves 32, 34 are located substantially symmetrically with respect to an apex 284 (304) of the respective end formations 28, 30. Referring to FIG. 1, a horizontal deflection coil 36 of a saddle type is directly wound on the inner surface of the coil frame 20 by utilizing the grooves 32, 34 formed therein, and a vertical deflection coil 38 is directly wound around the core 18 in toroidal form. The core 18, coil frame 20, horizontal coil 36, and vertical coil 38 constitute together the deflection yoke 16.

Figure 4:
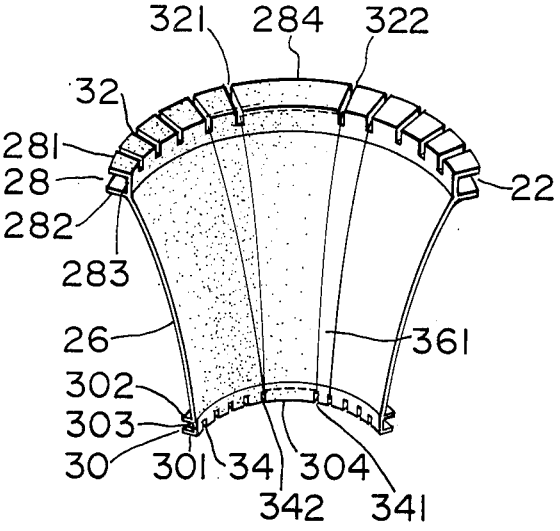
FIG. 4 is a similar view to FIG. 3, illustrating one manner of winding the conductor onto the coil frame shown in FIG. 3.

The manner of winding a conductor onto the upper frame half 22 to form the horizontal deflection coil 36 will now be described more fully. Referring to FIG. 4, a conductor 361 which is to form the horizontal coil 36 may comprise a single wire or a plurality of wires bundled together. The conductor is disposed along the inner surface of the frame half 22, and is fitted into and anchored to one of the grooves, 321, which is located closest to the apex 284 of the front end formation 28. Subsequently, the conductor 361 is led to extend over the annular portion 283 extending between the flanges 281, 282 and is passed into and anchored to one of the grooves, 322, which is located at a position substantially symmetrical to the groove 32) with respect to the apex 284. Thereafter, the conductor is disposed along the inner surface of the frame half 22 so as to extend toward the rear end formation 30, and is fitted into a groove 341 which is located closest to the apex 304 of the rear end formation 30. After the conductor 361 is anchored to the groove 341, it is led over the annular portion 303 extending between the flanges 301, 302 and is passed into a groove 342 which is located substantially symmetrically to the groove 341 with respect to the apex 304. Then the conductor is disposed along the inner surface of the frame half 22 so as to extend toward the front end formation 28, and is fitted into a groove thereof which is next to the first mentioned groove 321. Thereafter, the same procedure is repeated to form a saddle winding. A similar procedure is repeated with the lower frame half 24, and when the winding is complete, the upper and lower frame halves 22, 24 are joined together to complete a pair of saddle-shaped horizontal deflection coils 36, formed by the conductor 361 disposed on the inner surface of the coil frame 20.

In the above description, the coil frame has been described as being provided with the pair of front and rear end formations which are integral with the flare-shaped body. However, the body and the end formations may be formed separately and assembled together to provide a coil frame. Also, the pair of horizontal deflection coils may be directly wound in a saddle configuration on a single piece coil frame provided an available coil winding machine permits a consecutive laying of the conductor around the full circumference of the coil frame. While the vertical deflection coil has been described as being wound in a toroidal form on the core, it should be apparent that it may be directly wound on the inner surface of the coil frame in a saddle configuration generally in the similar manner as described in connection with the horizontal deflection coil. The grooves 32, 34 have been described as extending through one of the flanges into the annular portion, but it may be sufficient to have radial grooves in one flange, provided they have a sufficient depth to anchor the conductor placed therein.

Figure 5:
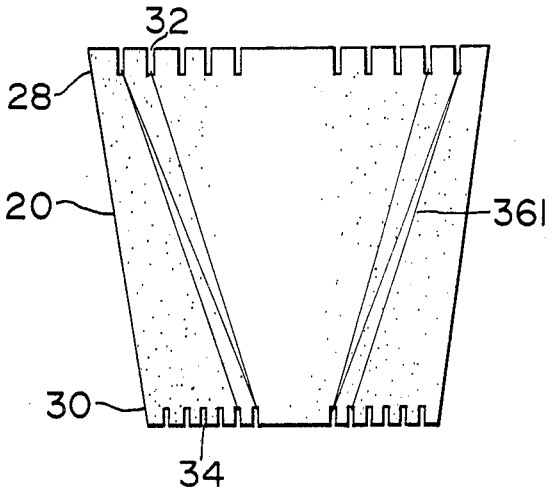
FIGS. 5 and 6 are developed views schematically illustrating other manners of winding the conductor onto the frame half shown in FIG. 4.
Figure 6:
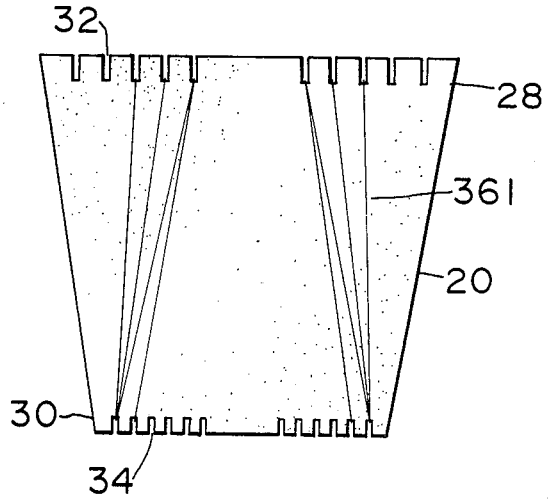
Figure 11:
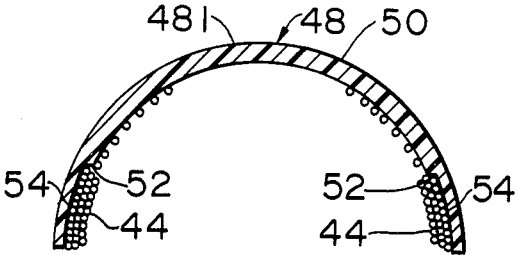
FIG. 11 is a cross section taken along the line XI—XI of the coil frame shown in FIG. 8.

It will be noted that the configuration and the distribution of turns of the deflection coil may be changed as desired by varying the arrangement of grooves in which the conductor is fitted. By way of example, FIG. 5 shows that the distance through which the conductor extends along the annular portion 283 is increased over the corresponding distance through which the conductor extends along the rear annular portion 303, while FIG. 6 shows that the relationship of these distances is reversed. In this manner, the distribution of turns can be changed as desired so as to produce a desired deflection field. The anchorage of the conductor which forms deflection coil in the respective grooves cut in the coil frame prevents a displacement in the position of the individual turns of the winding, thus maintaining an accurate distribution of turns to assure a good deflection characteristic. Irrespective of the number of turns, the use of the special wires which are treated to increase their adherence is avoided without any adverse influence upon the formation and the maintenance of a saddle-shaped coil, thus permitting a reduction in the amount of wire used and hence the cost of manufacturing.

Figure 7:
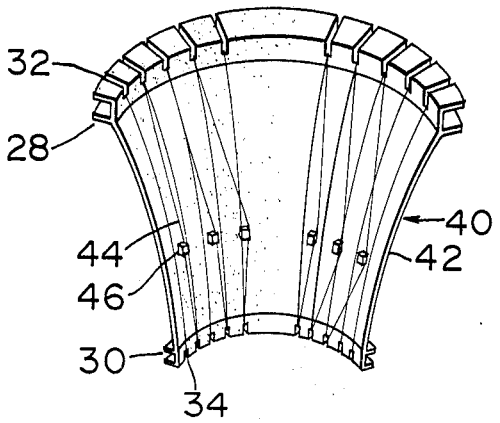
FIGS. 7 to 10 are perspective views of other embodiments of the coil frame.

FIGS. 7 to 10 show other embodiments of the coil frame. Referring to FIG. 7, there is shown a coil frame 40 of the general form as shown in FIG. 3, but including a body 42, on the inside of which is provided with a plurality of projections 46, formed either integrally with the frame 40 or adhesively secured thereto, which serve as means for constraining the position of turns of a conductor 44 which forms the deflection coil. As shown in FIG. 7, the projections 46 are in alignment with each other circumferentially of the frame 40, and it will be noted that a plurality of rows of such projections may be provided at a given spacing axially of the coil frame 40 or in a random arrangement.

With the coil frame 40 thus constructed, the position of the conductor 44 on the inner surface thereof can be constrained by engagement with the projections 46. For example, the spacing between adjacent turns of the conductor 44 can be reduced in the region of the projections 46 and increased toward the front end formation 28, thus achieving a particular distribution of turns of the deflection coil.

Figure 8:
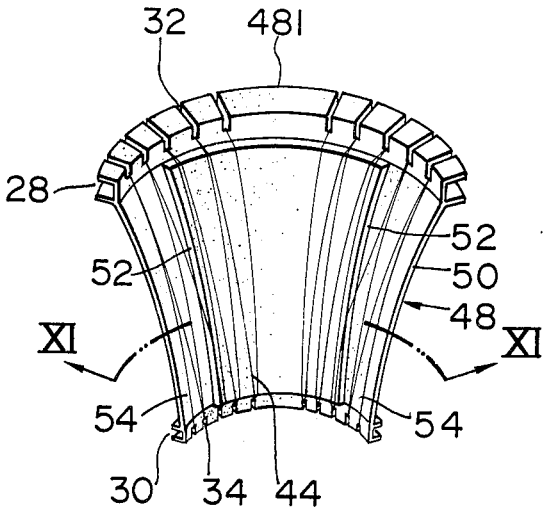

FIG. 8 shows a coil frame 48 which is similar to that shown in FIG. 3 and having a body 50 which is formed with a plurality of steps 52 extending axially of the body 50 which serve as means for constraining the position of the conductor 44 on the inner surface thereof. In this manner, the inner surface of the body 50 is formed with a recess 54. By utilizing such coil frame 48, there can be formed a coil having a concentrated distribution of turns of the conductor 44 in the recess 54 and a more sparse distribution of turns adjacent to the apex 481 of the coil frame 48. Such a distribution of turns may be effective to produce pin magnetic field.

Figure 9:
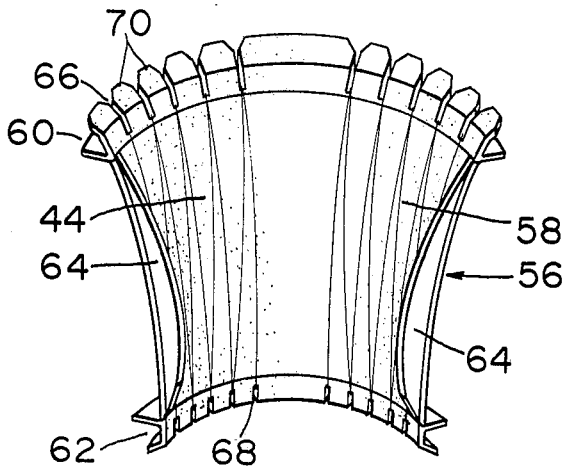

In FIG. 9, a coil frame 56 includes a body 58 which is provided with a pair of end formations 60, 62 at its front and rear ends. The body 58 is shown as formed in a pair of halves, in the similar manner as illustrated in FIGS. 3 and 4, and adjacent to its opposite lateral edges (or at a corresponding position where a single piece frame is used), the body 58 is formed with a pair of axially and radially extending tabs 64 of a size which does not prevent the insertion of the neck of the cathode ray tube into the body 58. Additionally, grooves 66, 68 which are cut in the respective end formations 60, 62 are enlarged toward their open end, as shown at 70. When the coil frame 56 is used to form a deflection coil of a saddle type which is suitable for producing pin magnetic field, the density of turns of the conductor 44 is gradually increased toward the opposite lateral sides of the frame 56. The provision of tabs 64 is effective to prevent a displacement or a disengagement of the conductor 44 in the region of the opposite lateral sides of the frame 56 where the density is increased. Such an arrangement is particularly effective when the coil frame is made in a pair of semi-sleeve halves. Since the open end of the grooves 66, 68 is broadened at 70, when inserting the conductor 44 thereinto, the laying of the conductor is facilitated.

Figure 10:
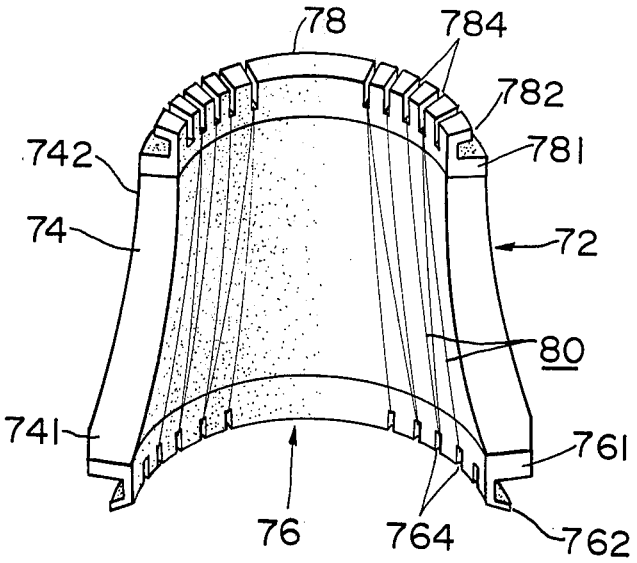

FIG. 10 shows a coil frame 72 having a body 74 which is formed as a core. The frame also includes a pair of front and rear end formations 76, 78 which are separate from the body 74. At its opposite ends 741, 742, the end face of the body or core 74 is provided with a circumferentially extending rib 743 (see FIG. 12) which serves as means for securing the end formations 76, 78 to the respective ends 741, 742. As indicated in FIG. 12, the end formations 76, 78 include a base portion 761, 781 adapted to be secured to the ends 741, 742 of the body 74, and a channel-shaped portion 762, 782 which is contiguous with the base portion 761, 781. In order to secure the end formations onto the body, the base portion 761, 781 is formed with a circumferentially extending groove 763, 783, respectively, which engages the rib 743 on the body 74 when they are assembled together. The channel-shaped portion 762, 782 is formed with a plurality of grooves 764, 784, which are formed in the similar manner as mentioned previously. A conductor 80 is directly wound on the inner surface of the body 74, by passing it through the grooves 764, 784 in the end formations 76, 78, to form a deflection coil of a saddle type. Since the body 74 is formed as a core, the material required for the coil frame 72 is reduced, thereby reducing the cost of manufacturing.

FIG. 13 shows a further embodiment of the deflection yoke according to the invention, and similar parts are designated by like numerals without repeating the description. A horizontal deflection coil of the type shown in FIG. 3 is combined with a vertical deflection coil of the type shown in FIG. 10 to constitute a deflection yoke 82.

Having described the invention, what is claimed is:

1. A deflection yoke including a core and a pair of horizontal and vertical deflection coils, comprising a sleeve-shaped coil frame including a flare-shaped body and a pair of end formations integrally formed at its front and rear ends thereby forming a single unitary frame member, each of the front and rear end formations being formed with a plurality of grooves, at least one of the deflection coils being directly wound on the inner surface of the coil frame in a saddle configuration by fitting and anchoring a conductor into the grooves.

2. A deflection yoke according to claim 1, further comprising means for constraining the position of the conductor on the inner surface of the body of the coil frame.

3. A deflection yoke according to claim 1 in which the spacing between adjacent turns of the conductor on the front end formation is different from the corresponding spacing on the rear end formation.

4. A deflection yoke according to claim 1 in which the open end of the grooves formed in the front and rear end formations is enlarged to facilitate entry of the conductor thereinto.

5. A deflection yoke according to claim 1 in which the coil frame is formed in a pair of semi-sleeve shaped halves.

6. A deflection yoke according to claim 1 in which the coil frame is a single piece sleeve-shaped body.

7. A deflection yoke according to claim 2 in which said means comprises a plurality of projections integrally formed on the inner surface of the body as a unitary structure, the conductor being engaged with the projections to form a bend in it.

8. A deflection yoke according to claim 2 in which said means comprises a plurality of axially extending steps integrally formed in the inner surface of the body of the coil frame as a unitary structure, thereby allowing the distribution of turns of the conductor to be varied across the inner surface of the coil frame.

9. A deflection yoke according to claim 2 in which said means comprises a tab integral with said body extending between the front and rear end formations on the inner surface of the body forming a unitary structure therewith for preventing a disengagement of the conductor from the inner surface thereof.

10. A deflection yoke according to claim 3 in which the spacing between adjacent turns of the conductor is increased toward the front end formation.

11. A deflection yoke according to claim 3 in which the spacing between adjacent turns of the conductor is reduced toward the front end formation.

* * * * *